United States Patent [19]

Takeuchi

[11] Patent Number: 4,733,981

[45] Date of Patent: Mar. 29, 1988

[54] MOTOR CONTROL SYSTEM OF PRINTER

[75] Inventor: Minoru Takeuchi, Tamayama, Japan

[73] Assignee: Alps Electric Co., Ltd., Japan

[21] Appl. No.: 893,978

[22] Filed: Aug. 7, 1986

[30] Foreign Application Priority Data

Aug. 8, 1985 [JP] Japan ..... 60-174840

[51] Int. Cl.[4] ..... B41J 21/08

[52] U.S. Cl. ..... 400/292; 400/76; 400/279; 400/322; 346/77 R

[58] Field of Search ..... 400/320, 322, 338, 279, 400/76, 283, 292, 337, 306; 346/77 R

[56] References Cited

U.S. PATENT DOCUMENTS 3,910,396 10/1975 Eischen et al. ..... 400/292
4,275,968 6/1981 Inwin ..... 400/582
4,311,399 1/1982 Wegryn et al. ..... 400/76
4,589,285 5/1986 Sato ..... 400/76 X

FOREIGN PATENT DOCUMENTS 62064 4/1983 Japan ..... 400/292
71183 4/1983 Japan ..... 400/292

*Primary Examiner*—Edgar S. Burr
*Assistant Examiner*—James R. McDaniel
*Attorney, Agent, or Firm*—Guy W. Shoup

[57] ABSTRACT

A motor control system of a printer of the type wherein a desired slow-up of a print head is effected by making use of the rotation of a stepping motor and printing is performed by the use of the head, which is characterized by a slow-up means for increasing gradually a drive frequency of the stepping motor from the stopped state of the head so as to provide a print speed required for the head to perform a print action thereby to result in a desired drive frequency, and a print processing means for instructing the head to perform printing, wherein the slow-up means effects slow-up over and beyond an inter-character space extending up to a next print character, and the print processing means instructs printing after passed over the inter-character space and even while slow-up is being effected, whereby the print speed can be enhanced while maintaining the quality of print.

2 Claims, 4 Drawing Figures

MOTOR CONTROL SYSTEM OF PRINTER

BACKGROUND OF THE INVENTION

1. Field of the Invention

This invention relates to control of the motor of a printer and, more particularly, to a motor control system of a printer of the type wherein printing of characters is performed while effecting slow-up over a space or interval between characters, which operates in such a manner that slow-up is effected even in a zone exceeding the space between characters and a print action is performed while slow-up is taking place.

2. Description of the Prior Art

As shown in FIG. 1, the printer comprises a platen 1, a carriage 3 for moving relatively a head 2, a carriage shaft 4 for supporting the carriage, and the combination for moving actually the carriage, composed of a transmission system 5, A-pulley 6, B-pulley 7, and stepping motor 8. Print action is performed in such a manner that a paper is colored by applying some print commands to the head 2 in synchronization with rotation of the stepping motor 8. As shown in FIG. 2, a printer drive circuit drives, by means of a microprocessor 9, the head 2 and stepping motor 8 by the use of a head driver 10 and motor driver 11. FIG. 3 is a drive timing chart showing a print action according to the prior art, of the head 2 and stepping motor 8, with showing the amount of head movement in correlation with the former. In this drawing, the abscissa indicates the time, and the ordinate indicates drive pulses applied to the head 2 and stepping motor 8 as well as the amount of movement of the carriage 3 when these pulses are applied.

In the conventional drive system, as represented by the curve A of FIG. 4, the drive frequency of the stepping motor 8 is slowed up from $f_1$ to $f_2$ by making use of steps corresponding to the number of characters, then, after the drive frequency required is attained, the stepping motor 8 is further driven at a constant speed, during which the print command is applied to the head 2 under the state of constant speed.

In the foregoing operation, by making use of the space between characters, slow-up is effected over that space.

It is desired to increase the print speed; however, according to the prior art, it is hardly possible to effect slow-up successfully thereby resulting in a desired high-speed state within the space between characters. That is, it is undesirable to try to attain a more high print speed than that attained in the prior art within the same number of steps as counted at the stepping timing of the stepping motor. The reason is that if the slow-up of the motor were effected rapidly, the movement of the carriage caused by rotation of the motor becomes not smooth, the quality of print is actually degraded, and there arises the phenomenon that characters are misaligned.

SUMMARY OF THE INVENTION

It is an object of the present invention to solve the foregoing problem, thus, to enhance the print speed while maintaining the quality of print.

To achieve the foregoing object, according to the present invention, slow-up of a stepping motor is effected for a longer interval than the extent of space between characters and a print action is commenced well within the period of the slow-up.

The foregoing technical measures are put into practice in the following manner: slow-up is commenced by the use of pulses of the maximum frequency within the self-startable frequency limits of the stepping motor, a nonprint zone is defined within the extent of space between characters, in the nonprint zone, after completion of about half, for example, of the slow-up, smooth rotation of the motor is maintained, and in the remaining steps, printing is started while effecting slow-up further, whereby the print speed can be enhanced while maintaining the quality of print.

DESCRIPTION OF THE PREFERRED EMBODIMENT

An embodiment of the present invention will now be described with reference to FIG. 4.

The curve A illustrated relates to the conventional control system of the stepping motor 8, whereas the curve B relates to the control system of the stepping motor 8 which is the embodiment of the present invention.

Figure 1:
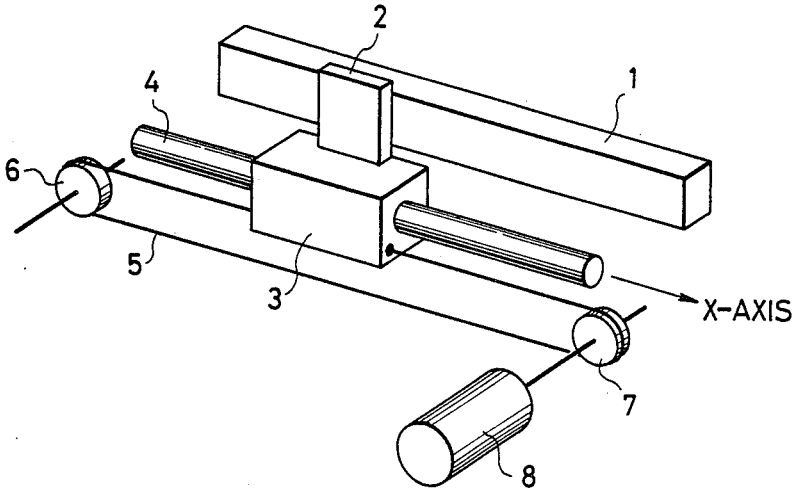
FIG. 1 is a configuration diagram of an example of a printer to which the present invention is applicable.
Figure 2:
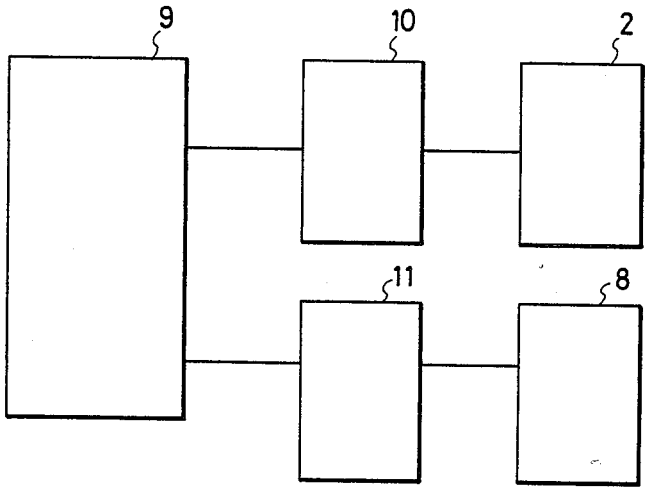
FIG. 2 is a block diagram of a printer control circuit.
Figure 3:
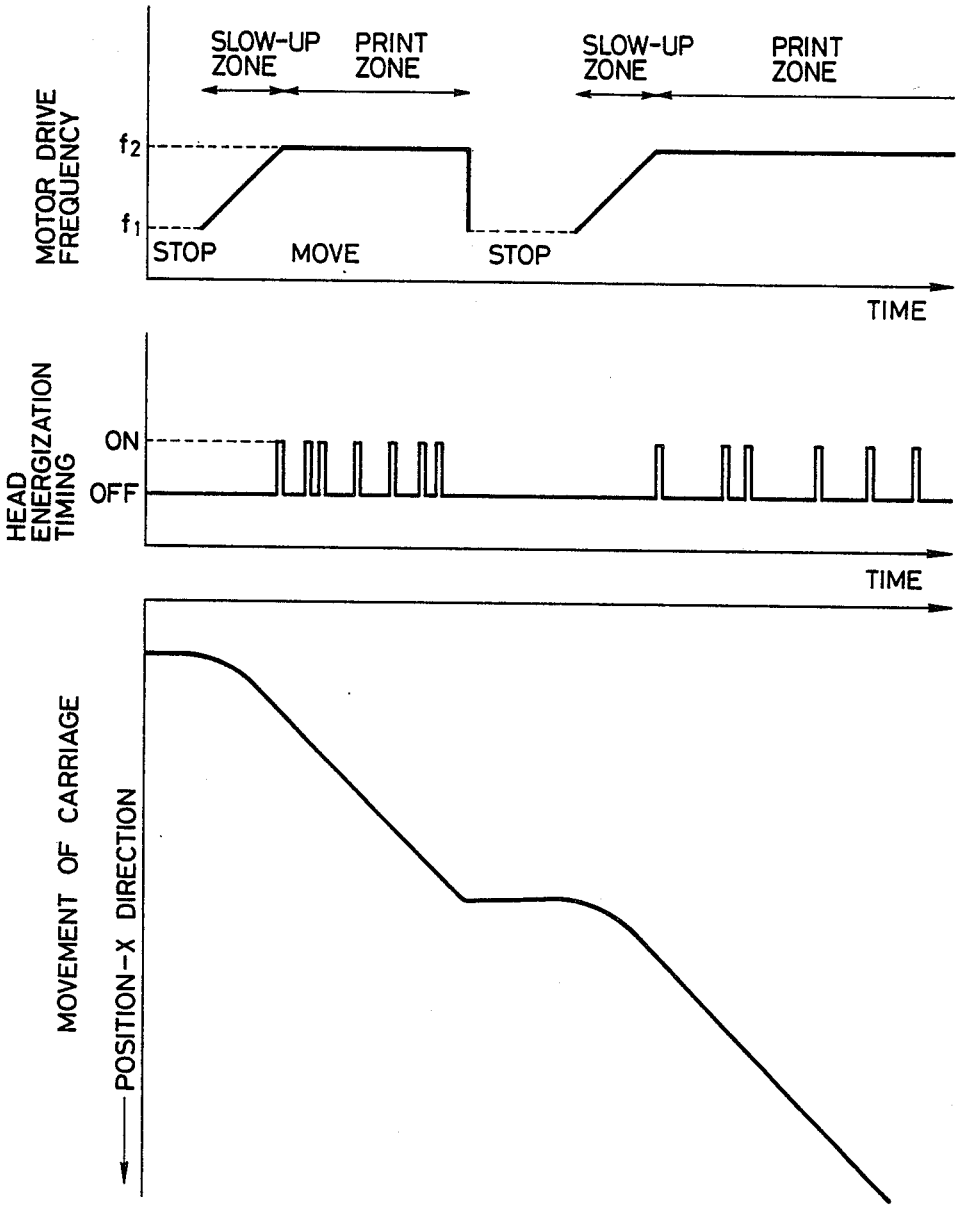
FIG. 3 is an operation timing chart of the printer and its control circuit.
Figure 4:
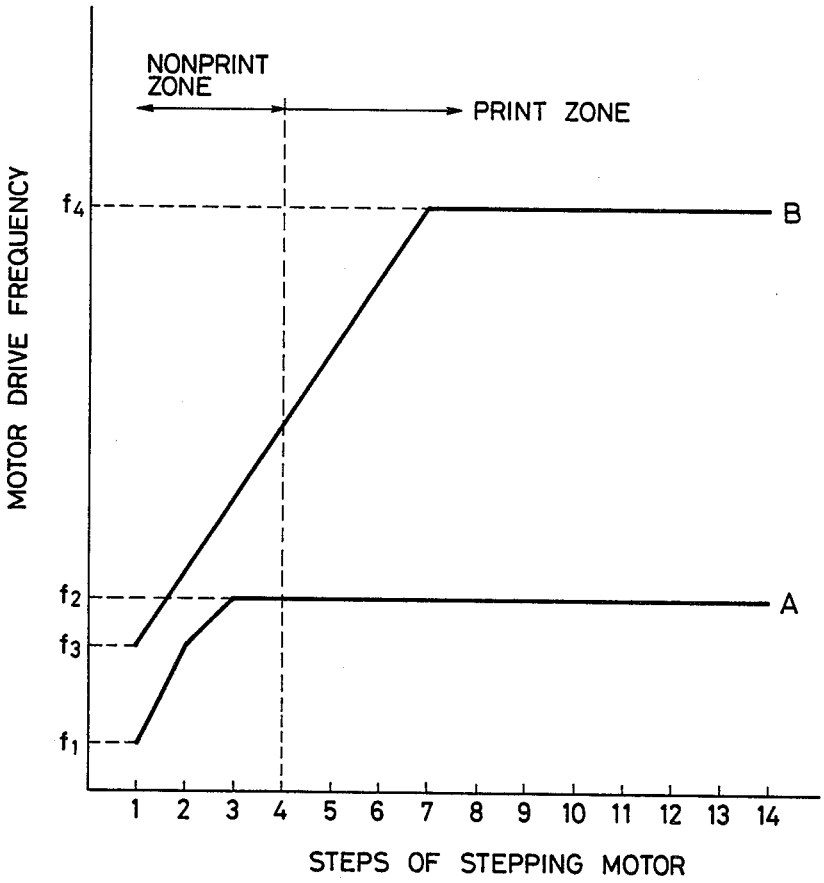
FIG. 4 is an explanation chart showing the operation (B) of an embodiment of the present invention, compared with the operation (A) of the conventional print system.

With respect to both the conventional and present control systems whose operations are illustrated in FIG. 4, a similar configuration to that of FIG. 1 is employable in the printer, and a similar configuration to that of FIG. 2 is employable in the printer control circuit.

According to the curve B of the present embodiment, the stepping motor 8 slows up from its self-startable frequency $f_3$ to the print frequency $f_4$, and after completion of a few steps falling under the nonprint zone, the print command is applied to the head 2 to commence printing.

Even during the foregoing operation, slow-up is effected, and as the slow-up terminates at $f_4$, the stepping motor 8 is driven at a constant speed. The print action is performed within the print zone illustrated. In the action above, the number of steps required in the slow-up varies dependig upon the type of printer.

By actualizing a drive system involving the feature of the curve B which represents the embodiment, at the moment of completion of the nonprint zone, the movement of the carriage 3 has passed through its transient state appearing in the beginning of start, and is smooth since then; thus, misalignment of characters is effectively prevented from occurring.

As described hereinabove, according to the present invention, the print speed in enhanced, but the quality of print can not be degraded. Further, because of driving at a high frequency, the current of the stepping motor decreases and the consumption power lessens; thus, the present invention is very advantageous. Furthermore, regarding a mechanical vibration, because the motor is driven at a high frequency, the vibration diminishes and noise lowers.

What is claimed is:

1. In a method for operating a motor control system for a printer having a print head, a stepping motor for moving the print head by driving the motor at drive frequencies applied by a motor driver, in conjunction with head energization signals applied by a head driver to the print head for printing on a record sheet, wherein a first drive frequency (f1) is a relatively low frequency corresponding to starting up of the motor to move the print head from the condition of being stopped, a second drive frequency (f2) corresponds to the motor being driven above the frequency where smooth rotation of the motor can be maintained without transients, a slow-up zone corresponds to the zone wherein the drive frequency is increasing from an initial frequency for starting up the motor to a final frequency wherein the motor is driven at a constant frequency for the desired printing speed of the print head, the improvement comprising starting up the motor to move the print head from the condition of being stopped at an initial, third drive frequency (f3) that is close to a maximum frequency limit within which the motor is self-startable, said third drive frequency being higher than the first drive frequency and less than the second drive frequency, increasing the drive frequency applied to the motor through the slow-up zone up to a final, fourth drive frequency (f4) which is a high frequency higher than the second drive frequency, in conjunction with applying head energization signals to the print head to commence printing at a time when the drive frequency is higher than the second drive frequency but still increasing in the slow-up zone, whereby the printing speed can be increased by commencing printing while the drive frequency of the motor is being increased through the slow-up zone.

2. A motor control system of a printer according to claim 1, wherein a print instruction is given after about a first half of the slow-up has been completed.

* * * * *